US008790858B2

(12) United States Patent
Hasegawa et al.

(10) Patent No.: US 8,790,858 B2
(45) Date of Patent: Jul. 29, 2014

(54) ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS, IMAGE FORMING METHOD

(75) Inventors: Toshiaki Hasegawa, Kanagawa (JP); Mona Tasaki, Kanagawa (JP); Fusako Kiyono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 7 days.

(21) Appl. No.: 13/572,175

(22) Filed: Aug. 10, 2012

(65) Prior Publication Data

US 2013/0209932 A1 Aug. 15, 2013

(30) Foreign Application Priority Data

Feb. 15, 2012 (JP) ..... 2012-030641

(51) Int. Cl.
*G03G 9/113* (2006.01)

(52) U.S. Cl.
USPC ..... 430/111.32; 430/111.35

(58) Field of Classification Search
USPC ..... 430/111.32, 111.35
See application file for complete search history.

(56) References Cited

U.S. PATENT DOCUMENTS

| | | | | |
|---|---|---|---|---|
| 5,900,344 | A | 5/1999 | Silence et al. | |
| 2009/0245858 | A1 * | 10/2009 | Mizutani et al. | 399/111 |

FOREIGN PATENT DOCUMENTS

| | | |
|---|---|---|
| JP | A-11-133673 | 5/1999 |
| JP | A-2005-10183 | 1/2005 |
| JP | A-2007-133093 | 5/2007 |
| JP | A-2008-122828 | 5/2008 |
| JP | A-2010-169992 | 8/2010 |

* cited by examiner

*Primary Examiner* — Hoa V Le
(74) *Attorney, Agent, or Firm* — Oliff PLC

(57) ABSTRACT

An electrostatic charge image developing carrier has magnetic particles and a coating resin layer that coats surfaces of the magnetic particles and contains a hindered amine compound.

16 Claims, 1 Drawing Sheet

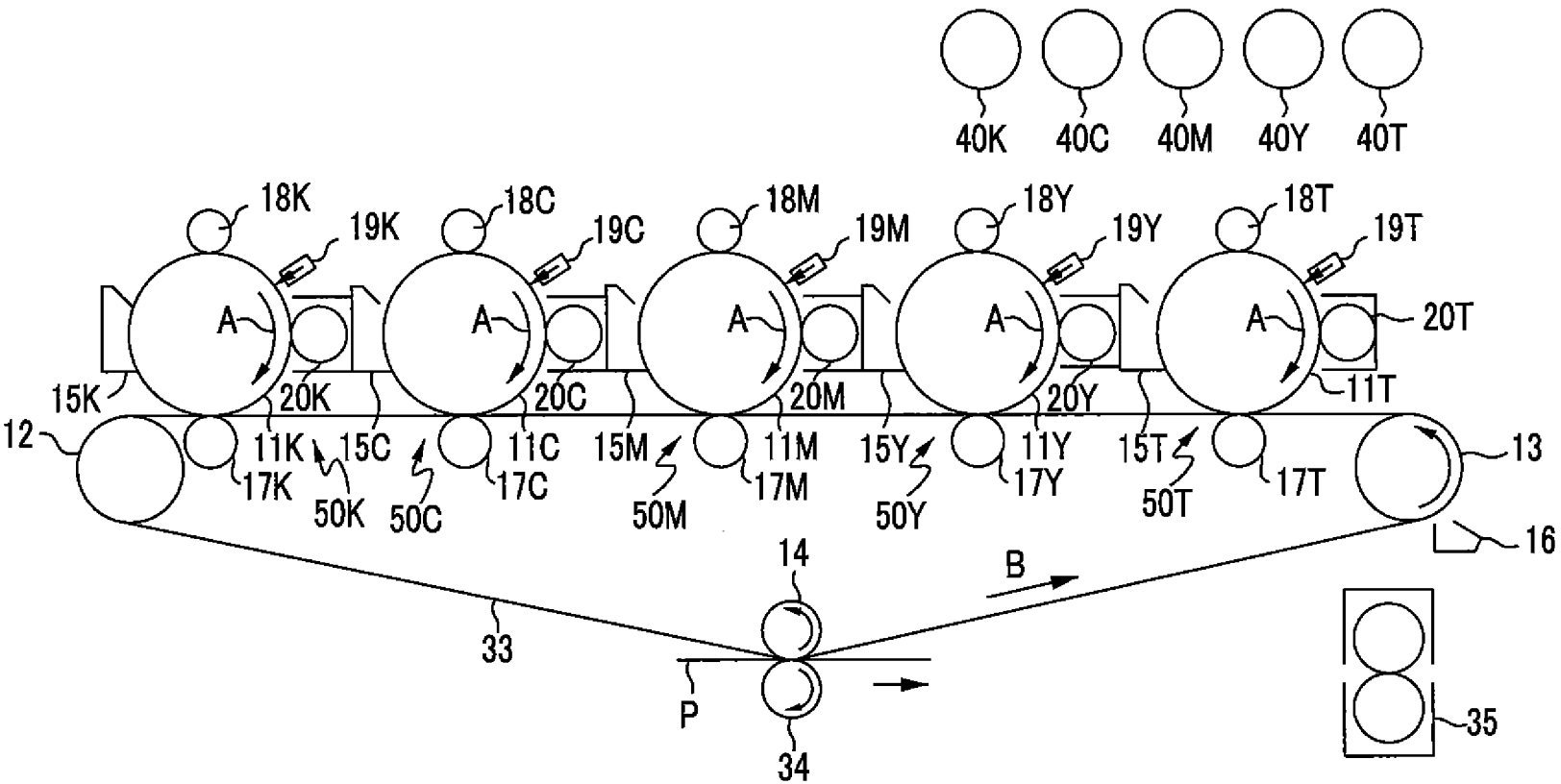
40T
40Y
40M
40C
40K
18T
19T
20T
11T
17T
15T
50T
18Y
19Y
20Y
11Y
17Y
15Y
50Y
18M
19M
20M
11M
17M
15M
50M
18C
19C
20C
11C
17C
15C
50C
18K
19K
20K
11K
17K
15K
50K
A
B
P
12
13
14
16
33
34
35

ELECTROSTATIC CHARGE IMAGE DEVELOPING CARRIER, ELECTROSTATIC CHARGE IMAGE DEVELOPER, DEVELOPER CARTRIDGE, PROCESS CARTRIDGE, AND IMAGE FORMING APPARATUS, IMAGE FORMING METHOD

CROSS-REFERENCE TO RELATED APPLICATIONS

This application is based on and claims priority under 35 USC 119 from Japanese Patent Application No. 2012-030641 filed Feb. 15, 2012.

BACKGROUND

1. Technical Field

The present invention relates to an electrostatic charge image developing carrier, an electrostatic charge image developer, a developer cartridge, a process cartridge, an image forming apparatus, and an image forming method.

2. Related Art

Electrophotography in which image information is visualized through electrostatic charge images is currently being used in a variety of fields. As the electrophotography of the related art, a method is generally used in which an electrostatic latent image is formed on a photoreceptor or an electrostatic recording member using a variety of units, and electroscopic fine particles, which are referred to as a toner, are adhered to the electrostatic latent image, thereby developing and visualizing the electrostatic charge image. The developer used herein is roughly classified into a two-component developer in which both supporting particles referred to as a carrier and toner particles are mutually rubbed and charged, thereby supplying an appropriate amount of positive or negative charge and a single-component developer in which a toner alone is used, such as a magnetic toner. Particularly, the two-component developer is being widely used since the carrier itself is provided with functions of stirring, transportation, charge supply, and the like, and functions required for a developer can be separated so that the design is easy.

In recent years, since there has been a demand for full colorization and quality improvement of images formed using an image forming apparatus in which electrophotography is employed, an increase in speed, and long-term stability of the process, an increasing number of studies have been made regarding a decrease in the size of particles in a toner, equalization of charge amount, and stabilization of charge amount in order to improve image quality. As the size of particles in the toner decreases, studies are being conducted regarding a decrease in the size of particles in the carrier as well, and a variety of studies are being conducted regarding resin compositions of a carrier-coating layer, and the like for uniformity or stabilization of the charge amount.

SUMMARY

According to an aspect of the invention, there is provided an electrostatic charge image developing carrier including magnetic particles and a coating resin layer that coats surfaces of the magnetic particles and contains a hindered amine compound.

BRIEF DESCRIPTION OF THE DRAWINGS

Exemplary embodiment of the present invention will be described in detail based on the following figures, wherein:

FIG. 1 is a schematic pattern diagram showing an example of the image forming apparatus of the present exemplary embodiment.

DETAILED DESCRIPTION

Hereinafter, embodiments of the electrostatic charge image developing carrier, electrostatic charge image developer, developer cartridge, process cartridge, image forming apparatus, and image forming method of an aspect of the invention will be described. Meanwhile, the embodiments are examples for carrying out the aspect of the invention, and the Aspect of the invention is not limited thereto.

Electrostatic Charge Image Developing Carrier

The electrostatic charge image developing carrier of the exemplary embodiment has magnetic particles and a coating resin layer that coats the surfaces of the magnetic particles and contains a hindered amine additive. Hereinafter, the electrostatic charge image developing carrier may be simply referred to as the "carrier."

It is considered that, in an actual machine, a toner and the carrier are stirred and transported so as to come into contact with each other such that the coating resin layer of the carrier gradually scrapes off due to stress that the carrier receives from the toner, and fragments scraped off from the coating resin layer of the carrier adhere to the toner during stirring and transportation. Therefore, it is assumed that a hindered amine additive is gradually supplied to the surface of the toner little by little during stirring and transportation by adding the hindered amine additive to the coating resin layer of the carrier. That is, since the coating resin layer of the carrier is scraped off, and, at the same time, the hindered amine additive included in the coating resin layer adheres to the surface of the toner, fading of a toner image is suppressed compared to a case in which the hindered amine additive is not included in the coating resin layer of the carrier. As a result, it is considered that an image for which discoloration due to light is suppressed is formed even in a case in which the image is formed using a colored toner and a transparent toner. In addition, it is considered that, since the hindered amine additive is continuously added to the surface of the toner through stirring and transportation, the amount of the hindered amine additive added decreases compared to a case in which the hindered amine additive is included in the toner, and deterioration of the fluidity or deterioration of the charging properties of the toner is prevented.

Magnetic Core Material Particles

Magnetic core material particles of the carrier used for the exemplary embodiment is not particularly limited, and examples thereof include magnetic metals, such as iron, steel, nickel, and cobalt; magnetic oxides, such as ferrite and magnetite; and the like.

Examples of ferrite are generally represented by the following formula.

$$(MO)_X(Fe_2O_3)_Y$$

In the formula, M contains at least one kind selected from Cu, Zn, Fe, Mg, Mn, Ca, Li, Ti, Ni, Sn, Sr, Al, Ba, Co, Mo, and the like; X and Y indicate a weight mole ratio; and X+Y=100 is satisfied.

In addition, the M is preferably ferrite particles including one kind or a combination of several kinds of Li, Mg, Ca, Mn, Sr, and Sn and 1% by weight or less of another component. Addition of Cu, Zn, and Ni elements easily decreases resistance, and charge leakage is liable to occur. Furthermore, it becomes hard to coat resin and environmental dependency becomes higher. Therefore, since the addition of Cu, Zn, and Ni elements increases the stress imposed on the carrier such that there is a case in which lifetime is shorter, the elements are preferably not included. Meanwhile, in recent years, ferrite to which a Mn or Mg element is added has been generally distributed from the viewpoint of safety.

In addition, the magnetic core material particles include resin particles having magnetic fine particles of the magnetic metal or magnetic oxide dispersed in a binder resin. A phenol resin, a melamine resin, an epoxy resin, a urethane resin, a polyester resin, a silicone resin, or the like can be used as the binder resin.

Coating Resin Layer

The carrier used in the exemplary embodiment has a coating resin layer that coats the surfaces of the magnetic particles and contains the hindered amine additive.

Hindered Amine Additive

The hindered amine additive is not particularly limited as long as the hindered amine additive is a compound including at least one or more 2,2,6,6-tetraalkyl piperidine structures and a molecular weight in a range of 400 to 4000. When the molecular weight of the hindered amine additive is 400 or more, the hindered amine additive is moved to the toner without contaminating the apparatus, and, when the molecular weight is 4000 or less, the hindered amine additive is preferably scraped so as be easily moved to the toner. The present additive acts as a radical capture agent, and suppresses light degradation. Specific examples of the hindered amine additive include bis(2,2,6,6-tetramethyl-4-piperidyl) sebacate, bis(1,2,2,6,6-pentamethyl-4-piperidyl)sebacate, 4-penzoyloxy-2,2,6,6-tetramethylpiperidine, and the like. The hindered amine additive may be a compound having a hindered phenol structure in the same molecule.

The hindered amine additive is preferably a solid at room temperature (25° C.) in consideration of the fluidity of the carrier and the like during addition to the coating resin layer. Since the hindered amine additive has a positive charge, a charge-supplying effect of the toner can be expected.

The content of the hindered amine additive is preferably from 0.1% by weight to 50% by weight, more preferably from 1.0% by weight to 30% by weight, still more preferably from 3.0% by weight to 30% by weight, and particularly preferably from 10.0% by weight to 20.0% by weight with respect to the total weight of the coating resin layer. When the content of the hindered amine additive is less than 0.1% by weight with respect to the total weight of the coating resin layer, there is a disadvantage that fading of a toner image is not sufficiently suppressed, and when the content exceeds 50% by weight, there is a disadvantage that the strength of a carrier-coated layer is not preferably kept.

In addition, the hindered amine additive may be used in combination with a hindered phenol antioxidant or an ultraviolet absorbing agent in order to enhance the light degradation suppression effect.

The hindered phenol antioxidant includes 2,6-di-t-butyl-4-methylphenol, 2,5-di-t-butylhydroquinone, N,N'-hexamethylene bis(3,5-di-t-butyl-4-hydroxyhydrocinnamide, 3,5-di-t-butyl-4-hydroxybenzyl phosphonate diethylester, 2,4-bis [(octylthio)methyl]-o-cresol, 2,6-di-t-butyl-4-ethylphenol, 2,2'-methylene bis(4-methyl-6-t-butylphenol), 2,2'-methylene bis(4-ethyl-6-t-butylphenol), 4,4'-butylidene bis(3-methyl-6-t-butylphenol), 2,5-di-t-amylhydroquinone, 2-t-butyl-6-(3-butyl-2-hydroxy-5-methylbenzyl)-4-methylphenylacrylate, 4,4'-butylidene bis(3-methyl-6-t-butylphenol), and the like.

As the ultraviolet absorbing agent, a poorly water-soluble benzophenone compound, benzotriazol compound, salicylate ester compound, oxalic acid amide compound, nickel complex, or other ultraviolet absorbing agent is used. The ultraviolet absorbing agent may be used singly or in combination of two or more kinds thereof. Among the above ultraviolet absorbing agents, the benzophenon ultraviolet absorbing agent is preferable due to also having antioxidation effects generally.

Resin

A resin that composes the coating resin layer is not particularly limited, and can be selected depending on purpose. Examples thereof include well-known resins, such as polyolefin resins, such as polyethylene and polypropylene; polyvinyl resins and polyvinylidene resins, such as polystyrene, an acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylate copolymers; straight silicone resins having an organosiloxane bond or denatured products thereof; fluororesins, such as polytetrafluoro ethylene, polyvinyl fluoride, polyvinylidene fluoride, and polychlorotrifluoro ethylene; silicone resins; polyester resins; polyurethane resins; polycarbonate resins; phenol resins; amino resins, such as a urea-formaldehyde resin, a melamine resin, a benzoguanamine resin, a urea resin, and a polyamide resin; and epoxy resins. The resins may be used singly or in combination of two or more kinds thereof.

Resin Particles

The coating resin layer according to the exemplary embodiment preferably has resin particles dispersed in the resin. The mixing rate of the hindered amine additive in the toner can be adjusted using the amount of the resin particles added. Examples of the resin particles include thermoplastic resin particles, thermosetting resin particles, and the like. Among the above, resin particles of a thermosetting resin is preferable from the viewpoint of a relatively easy increase in hardness, resin particles of a nitrogen-containing resin containing N atoms is preferable from the viewpoint of imparting negative charging properties to the toner, and a urea resin, a urethane resin, a melamine resin, a guanamine resin, and an amide resin are particularly preferable. The resin particles may be used singly or in combination of two or more kinds thereof.

The volume average particle diameter of the resin particles (hereinafter sometime simply referred to as the "average particle diameter") is preferably from 0.1 μm to 2 μm, and more preferably from 0.2 μm to 1 μm. When the volume average particle diameter of the resin particles is less than 0.1 the dispersibility of the resin particles in the coating resin layer is lower. On the other hand, when the volume average particle diameter of the resin particles exceeds 2 μm, the resin particles are liable to drop from the coating resin layer, and there is a case in which the intrinsic effect is not exhibited.

Conductive Particles

Examples of conductive particles of the exemplary embodiment include metals, such as gold, silver, and copper, titanium oxide, zinc oxide, tin oxide, barium sulfate, aluminum borate, potassium titanate, tin oxide doped with antimony, indium oxide doped with tin, zinc oxide doped with aluminum, metal-coating resin particles, carbon black, and the like. The above may be used singly or in combination of two or more kinds thereof. The amount of the resin, the resin particles, and the conductive particles coated on the surfaces of the magnetic particles is preferably from 0.5% by weight to 10.0% by weight, and more preferably from 0.7% by weight to 5.0% by weight. When the amount of the resin, the resin particles, and the conductive particles coated on the surfaces of the magnetic particles is less than 0.5% by weight, there is a disadvantage that the surface of the carrier may not be preferably coated, and when the amount of the resin, the resin particles, and the conductive particles coated on the surfaces of the magnetic particles exceeds 10% by weight, there is a disadvantage that it becomes difficult to preferably adjust carrier resistance.

In addition, the conductive particles included in the coating resin layer are preferably white conductive particles since the hue of an obtained image becomes favorable. This is because the hue of the image is not influenced even when the coating resin layer is peeled. The above effect becomes significant in a case in which the carrier which is used as a combination of a transparent toner or a yellow toner is a film including white conductive particles. The white conductive particles include particles of titanium oxide, zinc oxide, barium sulfate, aluminum borate, potassium titanate powder, and the like whose surface is coated with tin oxide, and particles of titanium oxide, zinc oxide, barium sulfate, and the like whose surface is coated with tin oxide are preferable.

Method of Forming the Coating Resin Layer

The method of forming the coating resin layer is not particularly limited, and examples thereof include a method in which the hindered amine additive is mixed and kneaded in the coating resin, a method in which the coating resin is powdered and the hindered amine additive is mechanically and chemically adhered to the powder, a method in which the hindered amine additive is dissolved in a solvent, mixed with the magnetic particles, and then the solvent is distilled away, thereby forming the coating resin layer, a method in which the hindered amine additive and the coating resin are pulverized to be approximately 1 μm or less, the pulverized additive and resin are mixed with the magnetic particles, and continuously stirred at the melting temperature or higher of the resin, thereby forming the coating resin layer, and the like.

The solvent used in the solution for forming the resin coated layer is not particularly limited as long as the solvent dissolves the above resin as a matrix resin, and may be selected from well-known solvents. Examples thereof include aromatic hydrocarbons, such as toluene and xylene; ketones, such as acetone and methyl ethyl ketone; ethers, such as tetrahydrofuran and dioxane; and the like. In a case in which the resin particles are dispersed in the coating resin layer, since the resin particles and the above particles as the matrix resin are dispersed in the thickness direction and the circumferential direction of the carrier surface, even when the carrier is used for a long period of time such that the coating resin layer wears, a similar surface to when unused may be maintained, and excellent charge imparting ability may be maintained for a long period of time to the above toner. Also, in a case in which the conductive particles are dispersed in the coating resin layer, since the conductive particles and the above resin as the matrix resin are dispersed in the thickness direction and the circumferential direction of the carrier surface, even when the carrier is used for a long time such that the coating resin layer wears, a similar surface to when unused may be maintained, and carrier deterioration may be prevented for a long period of time. Further, in a case in which the resin particles and the conductive particles are dispersed in the coating resin layer, the above effect is exhibited.

The electrical resistance (volume intrinsic resistance) of the carrier formed in the above manner is preferably from $10^6$ Ωcm to less than $10^{14}$ Ωcm under an electric field of $10^4$ V/cm. When the electrical resistance is less than $10^6$ Ωcm, the carrier easily adheres to an image portion on a latent image holding article, and flaws become easily caused on a developed image due to magnetic brush. When the electrical resistance is $10^{14}$ Ωcm or more, the toner may not be developed.

Meanwhile, the volume intrinsic resistance is measured in the following manner. A sample is placed on the bottom electrode plate of a measurement jig which is a pair of 20 $cm^2$-round (steel) electrode plates that are connected to an electrometer (manufactured by Keithley Instruments, trade name: KEITHLEY 610C) and a high-voltage power supply (manufactured by Fluke Corporation, trade name: FLUKE 415B) under conditions of 22° C. and a humidity of 55% so as to form a 1 mm to 3 mm-thick flat layer. Next, the top electrode plate is placed on the sample, and then a 4 kg-weight is placed on the top electrode plate in order to remove voids in the sample. The thickness of the sample is measured in the above state. Next, an electrical current value is measured by applying a voltage to both electrode plates, and a volume intrinsic resistance is calculated based on the following formula.

Volume intrinsic resistance=applied voltage×20÷(electrical current value−initial electrical current value)÷sample thickness In the above formula, the initial electrical current value refers to an electrical current value when the applied voltage is 0, and the electrical current value indicates a measured electrical current value.

The average film thickness of the resin coated layer is generally in a range of 0.1 μm to 10 μm, but is preferably in a range of 0.5 μm to 3 μm since a stable volume intrinsic resistance of the carrier is exhibited over time.

Electrostatic Charge Image Developer

The electrostatic charge image developer of the exemplary embodiment (hereinafter sometimes abbreviated to be the developer) includes an electrostatic charge image developing toner (hereinafter sometimes abbreviated to be the toner) and the above electrostatic charge image developing carrier. The toner may be a colored toner or a transparent toner. Firstly, the colored toner will be described.

Colored Toner

As the colored toner, a well-known toner including at least a colorant and a binder resin is used. Hereinafter, a preferable aspect of the colored toner will be described.

The binder resin used in the colored toner includes homopolymers or copolymers of styrenes, such as styrene and chlorostyrene; monoolefin, such as ethylene, propylene, butylene, and isoprene; vinyl ester, such as vinyl acetate, vinyl propionate, and vinyl benzoate; α-methylene aliphatic monocarboxylate ester, such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ether, such as vinyl methyl ether, vinyl ethyl ether, and vinyl butyl ether; vinyl ketone, such as vinyl methyl ketone, vinyl hexyl ketone, and vinyl isopropenyl ketone; and the like. The particularly typical binder resin include polystyrene, styrene-alkyl acrylate copolymer's, styrene-alkyl methacrylate copolymers, styrene-acrylonitrile copolymers, styrene-butadiene copolymers, styrene-maleic anhydride copolymers, polyethylene, and polypropylene. Furthermore, the binder resin includes polyester, polyurethane, an epoxy resin, a silicone resin, polyamide, denatured rosin, paraffin, waxes, and the like. Among the above, polyester is particularly preferably used as the binder resin.

The polyester resin used in the exemplary embodiment is a synthesized resin through condensation polymerization of a polyol (also referred to as "polyvalent alcohol") component and a polycarboxylic acid (also referred to as "polyvalent carboxylic acid") component. Meanwhile, in the exemplary embodiment, as the polyester resin, a commercially available product may be used, or a synthesized resin may be used.

Examples of the polyvalent carboxylic acid component include aliphatic dicarboxylic acids, such as oxalic acid, succinic acid, glutaric acid, adipic acid, suberic acid, azelaic acid, sebacic acid, 1,9-nonanedicarboxylic acid, 1,10-decandicarboxylic acid, 1,12-dodecanedicarboxylic acid, 1,14-tetradecanedicarboxylic acid, and 1,18-octadecanedicarboxylic acid; aromatic dicarboxylic acids, such as dibasic acid of phthalic acid, isophthalic acid, terephthalic acid, naphthalene-2,6-dicarboxylic acid, malonic acid, mesaconic acid, and the like; and the like, and further include anhydrides thereof and lower alkyl esters thereof, but the polyvalent carboxylic acid component is not limited thereto.

Examples of tri- or more valent carboxylic acid include 1,2,4-benzene tricarboxylic acid, 1,2,5-benzene tricarboxylic acid, 1,2,4-naphthalene tricarboxylic acid, and the like, and anhydrides thereof, lower alkyl esters thereof, and the like. The above may be used singly or in combination of two or more kinds thereof.

Furthermore, the polyvalent carboxylic acid component more preferably contains a carboxylic acid component having a double bond in addition to the aliphatic dicarboxylic acid or the aromatic dicarboxylic acid. The dicarboxylic acid having a double bond is preferably used in order to prevent hot offset during fixing since the dicarboxylic acid may be radically crosslinked through the double bond. Examples of the dicarboxylic acid include maleic acid, fumaric acid, 3-hexenedioic acid, 3-octenedioic acid, and the like, but the dicarboxylic acid is not limited thereto. In addition, examples thereof also include a lower ester thereof, acid anhydrides thereof, and the like. Among the above, fumaric acid, maleic acid, and the like are exemplified in terms of costs.

Meanwhile, as the polyol component, divalent alcohols include alkylene (having 2 to 4 carbon atoms) oxide adducts (average added molar number of 1.5 to 6) of bisphenol A, such as polyoxypropylene(2.2)-2,2-bis(4-hydroxyphenyl)propane and polyoxyethylene(2.2)-2,2-bis(4-hydroxyphenyl)propane; ethylene glycol, propylene glycol, neopentyl glycol, 1,4-butanediol, 1,3-butanediol, 1,6-hexanediol, and the like. Examples of tri- or more valent alcohols include sorbitol, pentaerythritol, glycerol, trimethylol propane, and the like.

Among the above raw material monomers, di- or more valent secondary alcohols and/or di- or more valent aromatic carboxylic acid compounds are preferable as an amorphous polyester resin. The di- or more valent secondary alcohol includes propylene oxide adducts of bisphenol A, propylene glycol, 1,3-butanediol, glycerol, and the like, and, among the above, propylene oxide adducts of bisphenol A are preferable. As the di- or more valent aromatic carboxylic acid compound, terephthalic acid, isophthalic acid, phthalic acid, and trimellitic acid are preferable, and terephthalic acid and trimellitic acid are more preferable.

In addition, a resin having a softening point of 90° C. to 150° C., a glass transition temperature of 55° C. to 75° C., a number average molecular weight of 2000 to 10000, a weight average molecular weight of 8000 to 150000, and an acid value of 5 mg KOH/g to 30 mg KOH/g is particularly preferable.

The method of manufacturing the polyester resin is not particularly limited, and includes an ordinary polyester polymerization method in which an acid component and an alcohol component are made to react with each other. Examples thereof include direct polycondensation, an ester exchange method, and the like, and the method is selected according to the kind of the monomer so as to manufacture the polyester resin.

The polyester resin is manufactured through a condensation reaction of the above polyol and a polyvalent carboxylic acid using an ordinary method. For example, the polyester resin is manufactured by mixing the above polyol, a polyvalent carboxylic acid, and a catalyst, as necessary, in a reaction vessel having a thermometer, a stirring device, and a downstream-type condenser, heating the mixture to 150° C. to 250° C. in the presence of an inert gas (nitrogen gas or the like), continuously removing a byproduct of a low-molecular compound from the reaction system, stopping the reaction at a point in time when the mixture reaches a desired acid value, cooling the mixture, and obtaining a target reactant.

In addition, the colorant in the exemplary embodiment is selected from the viewpoint of hue angle, chroma, brightness, weather resistance, OHP permeability (permeability of an image when a transparent film is used as a recording sheet), and dispersibility in the toner. The colorant includes typical colorants, such as carbon black, nigrosine, aniline blue, chalco oil blue, chrome yellow, ultramarine blue, Dupont oil red, quinoline yellow, methylene blue chloride, phthalocyanine blue, malachite green oxalate, lamp black, rose Bengal, C.I. Pigment Red 48:1, C.I. Pigment Red 122, C.I. Pigment Red 57:1, C.I. Pigment Red 238, C.I. Pigment Yellow 97, C.I. Pigment Yellow 12, C.I. Pigment Yellow 180, C.I. Pigment Blue 15:1, and C.I. Pigment Blue 15:3.

The amount of the colorant added to the colored toner of the exemplary embodiment is preferably in a range of 4 parts by weight to 20 parts by weight with respect to 100 parts by weight of the binder resin included in the toner.

The colored toner in the exemplary embodiment may also include one or more charge-controlling agents that adjust charging as an internal additive in addition to the above components. In addition, the colored toner may include a petroleum resin in order to satisfy the pulverizing properties or heat conservation properties of the toner. The petroleum resin refers to a synthesized resin for which diolefine and monoolefine included in a decomposed oil fraction which is a byproduct from an ethylene plant that generates ethylene, propylene, and the like from steam cracking of petroleum products are used as raw materials.

Transparent Toner

The transparent toner of the exemplary embodiment refers to a toner used for a transparent toner image formed with a colored toner image. The transparent toner specifically refers to a white toner in which the content of a colorant, such as a pigment and a dye, is 0.01% by weight or less, and includes toners containing the same components as for the colored toner of the exemplary embodiment except the content of the colorant. The transparent toner image is formed on a recording medium (transfer medium) in a portion in which a colored toner image is not present, and is formed on a colored toner image in a portion in which a colored toner image is present. In addition, the transparent toner image may be formed only on a colored toner image.

Method of Manufacturing the Toner

The method of manufacturing the colored toner and the transparent toner according to the exemplary embodiment (hereinafter sometimes referred to as "the respective toners according to the exemplary embodiment") includes dry manufacturing methods, such as kneading and pulverizing, and wet manufacturing methods, such as a suspension polymerization method and an emulsification aggregation method. Among the above, the emulsification aggregation method is preferable since the toner shape can be controlled as necessary from an infinite shape to a spherical shape by selecting the heating temperature condition, and the emulsification aggregation method is advantageous when controlling the toner shape precisely. The emulsification aggregation method is a method in which a resin dispersion liquid is manufactured through emulsification polymerization or emulsification, meanwhile, a colorant dispersion liquid having a colorant dispersed in a solvent and a dispersion liquid in which a release agent is dispersed are prepared and mixed so as to form aggregated particles corresponding to the toner particle diameter, the aggregated particles are heated and coalesced, thereby obtaining toner particles.

Next, the method of manufacturing the toner through the emulsification aggregation method which is preferable when the respective toners of the exemplary embodiment are manufactured will be described in more detail. The method of manufacturing the toner through the emulsification aggregation method is a method including an aggregation process, an adhesion process, and a coalescence process. Hereinafter, each of the respective processes will be described in more detail.

Aggregation Process

In the aggregation process, firstly, an aggregating agent is added to a mixed dispersion liquid obtained by mixing a first binder resin dispersion liquid, a colorant dispersion liquid, furthermore, a release agent dispersion liquid used as necessary, and other components, and the mixture is heated at a temperature lower than the glass transition temperature of the binder resin, thereby forming aggregated particles in which particles composed of the respective components are aggregated (core aggregated particles). For formation of the aggregated particles, the core aggregated particles having a narrow particle size distribution can be obtained by adding the aggregating agent under stirring using a rotary shearing homogenizer at room temperature (25° C.).

Adhesion Process

In the adhesion process, resin particles composed of the binder resin are further adhered to surfaces of the core particles (core aggregated particles or core coalesced particles) including the binder resin formed through the aggregation process, thereby forming a coated layer (hereinafter the aggregated particles provided with the coated layer on the core particle surfaces will be referred to as the "adhered resin aggregated particles"). Here, the coated layer corresponds to a shell layer of the toner of the exemplary embodiment formed through the coalescence process which will be described below. The subsequently adhered binder resin may be the same as or different from the binder resin composing the core aggregated particles. The coated layer may be formed by adding a second resin particle dispersion liquid to a dispersion liquid in which the core particles have been formed in the aggregation process, and other components may also be added at the same time as necessary.

When the adhered resin aggregated particles are adgered to surfaces of the core particles so as to form a coated layer, and the adhered resin aggregated resin is heated and coalesced in the coalescence process described below, resin particles composed of the binder resin included in the coated layer on the surfaces of the core particles are melted so as to form the shell layer. Therefore, exposure of the components of the release agent and the like included in the core layer locating inside the shell layer to the surface of the toner is effectively prevented.

The method of adding and mixing the second resin particle dispersion liquid in the adhesion process is not particularly limited, and, for example, adding and mixing may be carried out gradually and continuously, or may be carried out in a stepwise manner plural times. When the resin particle dispersion liquid is added and mixed in the above manner, occurrence of fine particles is suppressed, and the particle size distribution of the obtained toner may be narrowed. In the exemplary embodiment, the number of times the adhesion process is performed may be once or plural times.

Coalescence Process

In the coalescence process, the adhered resin aggregated particles obtained through heating in the adhesion process are coalesced. The coalescence process is carried out at a temperature higher than the glass transition temperature of the binder resin that composes the aggregated particles. Meanwhile, in a case in which plural binder resins are used, the coalescence process is preferably carried out at a temperature higher than the glass transition temperature of the binder resin that accounts for the largest component. The coalescence time may be short as long as the heating temperature is high, and needs to be long when the heating temperature is low. That is, since the coalescence time is dependent on the heating temperature, the coalescence time may not be indiscriminately specified, but is generally 30 minutes to 10 hours.

Washing/Drying Process

The coalesced particles obtained through the coalescence process are subjected to solid-liquid separation, such as filtration, washing, and drying. Therefore, a toner having no external additive added thereto may be obtained. The solid-liquid separation is not particularly limited, but suction filtration, pressurization filtration, and the like are preferable in terms of productivity. The washing is preferably substitution washing using ion exchange water in terms of charging properties. For the drying process, an ordinary method is selected as necessary from a vibration-type fluidized drying method, a spray drying method, a freezing drying method, a flash jet method, and the like.

Next, the method of preparing the binder resin dispersion liquid, the colorant dispersion liquid, and the release agent dispersion liquid which are used in the aggregation process will be described. A well-known emulsification method is used in order to prepare the binder resin dispersion liquid, and a phase-transfer emulsification method is effective since the obtained particle size distribution is narrow, and the volume average particle diameter is in a range of 100 nm to 400 nm.

In the phase-transfer emulsification method, the resin is dissolved in an organic solvent that dissolves the resin, and, furthermore, in a single amphiphilic organic solvent or mixed solvent thereof so as to prepare an oil phase. A small amount of a basic compound is added dropwise while stirring the oil phase, furthermore, water is added dropwise while stirring the mixture, and water droplets are incorporated into the oil phase. Next, when the amount of water added dropwise exceeds a certain amount, the oil phase and the water phase are transferred to each other so that the oil phase turns into oil droplets. After that, a solvent removal process under depressurization is carried out, and an aqueous dispersion liquid is obtained.

Here, the amphiphilic organic solvent refers to an organic solvent having a solubility in water at 20° C. of at least 5 g/L or more, and preferably 10 g/L or more. The amphiphilic organic solvent having a solubility of less than 5 g/L is poor in terms of the effect of accelerating the waterborne treatment rate, and there is another problem in that the obtained aqueous dispersion member is also poor in terms of storage stability. In addition, such organic solvents include alcohols, such as ethanol, n-propanol, isopropanol, n-butanol, isobutanol, sec-butanol, tert-butanol, n-amylalcohol, isoamylalcohol, sec-amylalcohol, tert-amylalcohol, 1-ethyl-1-propanol, 2-methyl-1-butanol, n-hexanol, and cyclohexanol; ketones, such as methyl ethyl ketone, methyl isobutyl ketone, ethyl butyl ketone, cyclohexanone, and isophorone; ethers, such as tetrahydrofuran and dioxane; esters, such as ethyl acetate, acetic acid-n-propyl, isopropyl acetate, acetic acid-n-butyl, isobutyl acetate, acetic acid-sec-butyl, acetic acid-3-methoxybutyl, methyl propionate, ethyl propionate, diethyl carbonate, and dimethyl carbonate; glycol derivatives, such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; furthermore, 3-methoxy-3-methyl butanol, 3-methoxy butanol, acetonitrile, dimethylformamide, dimethylacetamide, diacetone alcohol, ethyl acetoacetate, and the like. The solvent may be used singly or in combination of two or more kinds thereof.

Next, with regard to the basic compound, the polyester resin is preferably neutralized in a basic compound when being dispersed in an aqueous medium. At this time, the neutralization reaction of the polyester resin with a carboxylic group acts as an impetus for forming a waterborne polyester resin, and, furthermore, aggregation between particles is prevented due to an electrical repulsive force between the generated carboxyl anions. The basic compound includes ammonia, organic amine compounds having a boiling point of 250° C. or lower, and the like. Preferable examples of the organic amine compound include triethylamine, N,N-diethylethanolamine, N,N-dimethyl ethanolamine, amino ethanolamine, N-methyl-N,N-diethanolamine, isopropylamine, iminobispropylamine, ethylamine, diethylamine, 3-ethoxy propylamine, 3-diethylamino propylamine, sec-butylamine, propylamine, methylamino propylamine, dimethylamino propylamine, methyliminobispropylamin, 3-methoxypropylamine, monoethanolamine, diethanolamine, triethanolamine, morpholine, N-methylmorpholine, N-ethylmorpholine, and the like. The basic compound is preferably added at a minimum of an amount at which the basic compound is partially neutralized, that is, 0.2 time equivalent weight to 9.0 times equivalent weight, and more preferably added at 0.6 time equivalent weight to 2.0 times equivalent weight with respect to the carboxylic group according to the carboxylic group included in the polyester resin. At an amount of less than 0.2 time equivalent weight, the effect of addition of the basic compound may not be observed, and, when the amount exceeds 9.0 times equivalent weight, while it is considered to be because the hydrophilicity of the oil phase increases excessively, since the particle diameter distribution becomes wide, and a favorable dispersion liquid may not be obtained, it is liable to be difficult to narrow the subsequent particle size distribution of the toner.

The colorant dispersion liquid is formed by at least dispersing a colorant. The colorant is dispersed using a well-known method, and, for example, a dispersing machine, such as a media-type dispersing machine, such as a rotary shearing homogenizer, a ball mill, a sand mill, or an attritor; or a high-pressure counter collision-type dispersing machine, is preferably used. In addition, an ionic surfactant having a polarity is used for the colorant, and dispersed in an aqueous solvent using the above homogenizer, thereby preparing a colorant particle dispersion liquid. The colorant may be used singly or in combination of two or more kinds thereof. The volume average particle diameter of the colorant is generally at largest 1.0 μm (that is, 1 μm or less).

In addition, the toner may include a release agent. The release agent dispersion liquid is formed by at least dispersing a release agent. The release agent is dispersed using a well-known method, and, for example, a dispersing machine, such as a media-type dispersing machine, such as a rotary shearing homogenizer, a ball mill, a sand mill, or an attritor; or a high-pressure counter collision-type dispersing machine, is preferably used. In addition, an ionic surfactant having a polarity is used for the release agent, and dispersed in an aqueous solvent using the above homogenizer, thereby preparing a release agent particle dispersion liquid. In the exemplary embodiment, the release agent may be used singly or in combination of two or more kinds thereof. The volume average particle diameter of the release agent particles is preferably at largest 1 μm (that is, 1 μm or less), and more preferably 0.01 μm to 1 μm.

A preferable release agent includes polyolefins having a low molecular weight, such as polyethylene, polypropylene, and polybutene; silicones whose softening point is shown by heating; aliphatic amides, such as oleic amide, erucamide, ricinolamide, and stearamide; plant waxes, such as a carnauba wax, a rice wax, a candelilla wax, a Japanese wax, and jojoba oil; animal waxes, such as bees wax; mineral and petroleum waxes, such as montan wax, ozokerite, ceresin, a paraffin wax, a microcrystalline wax, and a Fischer-Tropsch wax; ester waxes of a higher aliphatic acid and a higher alcohol, such as stearyl stearate and behenyl behenate; ester waxes of a higher aliphatic acid and a mono- or polyvalent lower alcohol, such as butyl stearate, propyl oleate, glyceride monostearate, glyceride distearate, and pentaerythritol tetrabehenate; ester waxes of a higher aliphatic acid and a polyol multimer, such as diethylene glycol monostearate, dipropylene glycol distearate, diglyceride distearate, and triglyceride tetrastearate; sorbitan higher aliphatic ester waxes, such as sorbitan monostearate; cholesterol higher aliphatic ester waxes, such as cholesterol stearate; and the like. The release agent may be used singly or in combination of two or more kinds thereof.

The combination of the resin of the resin particles, the colorant, and the release agent is not particularly limited, and is freely selected according to purpose. In the exemplary embodiment, other components (particles), such as an internal additive, a charge-controlling agent, an inorganic grain, an organic grain, a lubricant, and an abrasive, are dispersed in at least any of the binder resin dispersion liquid, the colorant dispersion liquid, and the release agent dispersion liquid. In this case, the above components (particles) may be dispersed in at least any of the binder resin dispersion liquid, the colorant dispersion liquid, and the release agent dispersion liquid, and a dispersion liquid formed by dispersing the above components (particles) may be mixed with a liquid mixture obtained by mixing the resin particle dispersion liquid, the colorant dispersion liquid, and the release agent dispersion liquid.

The volume average particle diameter of the particle dispersion liquid obtained in the above manner is measured using, for example, a laser diffraction-type particle size distribution measuring apparatus (LA-700, manufactured by Horiba Ltd.). In the measurement method, a sample in a dispersion liquid state is adjusted so that the solid content becomes 2 g, and ion exchange water is added to the sample, thereby preparing 40 mL of the sample. The sample is put into a cell until an appropriate concentration is obtained, left to stand idle for 2 minutes, and the volume average particle diameter is measured when the concentration in the cell becomes stable. The volume average particle diameters of the respective obtained channels are accumulated from the smaller volume average particle diameter, and the volume average particle diameter at which the cumulative volume average particle diameters become 50% is used as the volume average particle diameter.

The volume average particle diameter of the respective toners of the exemplary embodiment is preferably from 3 μm to 9 μm, and more preferably from 3 μm to 8 μm. When the volume average particle diameter of the respective toners is less than 3 μm, the charging properties become insufficient, and the developing properties lower, and, when the volume average particle diameter exceeds 9 μm, the resolution of an image is lower.

In addition, the respective toners of the exemplary embodiment preferably have a volume average particle size distribution index GSDv of 1.30 or less. If the volume average particle size distribution index GSDv exceeds 1.30, the resolution of an image lowers. Meanwhile, in the exemplary embodiment, the value of the particle diameter of the toner or the volume average particle size distribution index GSDv is measured and calculated in the following manner. Firstly, the cumulative distribution of the particle size distribution of the toner which is measured using a measurement device, such as a COULTER MULTISIZER II (manufactured by Beckman Coulter Inc.) is drawn with respect to divided particle size ranges (channels) from a smaller diameter side in terms of the volumes of the respective toner particles, a particle diameter at which the cumulative distribution becomes 16% is defined to be a volume average particle diameter D16v, and a particle diameter at which the cumulative distribution becomes 50% is defined to be a volume average particle diameter D50v. In accordance with the above method, a particle diameter at which the cumulative distribution becomes 84% is defined to be a volume average particle diameter D84v. At this time, the volume average particle size distribution index (GSDv) is calculated using a relational expression thereof which is defined to be D84v/D16v.

In addition, the respective toners of the exemplary embodiment preferably has a shape coefficient SF1(=((the absolute maximum length of the toner diameter)2/the projection area of the toner)×(π/4)×100) in a range of 110 to 160. Meanwhile, the shape coefficient SF1 is more preferably in a range of 125 to 140. Meanwhile, the value of the shape coefficient SF1 shows the roundness of the toner, becomes 100 in the case of a true spherical shape, and increases as the shape of the toner becomes more infinite. In addition, values necessary for computation using the shape coefficient SF1, that is, the absolute maximum length of the toner diameter and the projection area of the toner are obtained by photographing a toner particle image at a magnification of 500 times using an optical microscope (manufactured by Nikon Corporation, Microphoto-FXA), introducing the obtained image information to, for example, an image analysis apparatus (Luzex III) manufactured by Nicolet Corporation through an interface, and carrying out an image analysis. Meanwhile, the average value of the shape coefficient SF1 is calculated based on data obtained by measuring 1000 randomly sampled toner particles.

In a case in which the shape coefficient SF1 is less than 110, generally, a residual toner is generated in the transfer process during formation of an image, and therefore it becomes necessary to remove the residual toner, but cleaning properties when the residual toner is cleaned using a blade or the like are liable to be impaired, and, consequently, there is a case in which image defects occur. On the other hand, in a case in which the shape coefficient SF1 exceeds 160, there is a case in which the toner is damaged due to collision with the carrier in a developing machine when the toner is used as a developer. At this time, consequently, there is a case in which fine powder increases, which make the surface of the photoreceptor and the like contaminated by the release agent component exposed to the surface of the toner so as to impair the charging characteristics, and also there is a problem in that fogging or the like is caused by the fine powder.

In addition, for the purpose of imparting fluidity or improvement in cleaning properties, inorganic particles or inorganic oxide particles of silica, alumina, titania, calcium carbonate, and the like or resin particles of a vinyl resin, polyester, silicone, and the like can be added as a fluidity aid or a cleaning aid to the surface of the toner according to the exemplary embodiment by applying a shear in a dried state after drying.

The inorganic oxide particles added to the toner include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$ (n is an integer of 1 to 6), $Al_2O_3.2SiO_2$, $CaCO_3$, $MgCO_3$, $BaSO_4$, $MgSO_4$, and the like. Among the above, silica particles and titania particles are particularly preferable. The surfaces of the inorganic oxide particles are preferably subjected to a hydrophobization treatment in advance. The hydrophobization treatment is more effective for improvement in the powder fluidity of the toner, the environment dependency of charging, and carrier contamination resistance.

The hydrophobization treatment is carried out by immersing the inorganic oxide particles in a hydrophobizing agent, or the like. The hydrophobization treatment agent is not particularly limited, and examples thereof include a silane coupling agent, silicone oil, a titanate coupling agent, an aluminum coupling agent, and the like. The treatment agent may be used singly or in combination of two or more kinds thereof. Among the above, a silane coupling agent is preferably used.

Examples of the silane coupling agent include any types of chlorosilane, alkoxysilane, silazane, and a special silylation agent. Specific examples include methyl trichlorosilane, dimethyl dichlorosilane, trimethyl chlorosilane, phenyl trichlorosilane, diphenyl dichlorosilane, tetramethoxysilane, methyl trimethoxysilane, dimethyl dimethoxysilane, phenyl trimethoxysilane, diphenyl dimethoxysilane, tetraethoxysilane, methyl triethoxysilane, dimethyl diethoxysilane, phenyl triethyoxysilane, diphenyl diethoxysilane, isobutyl triethoxysilane, decyltrimethoxysilane, hexamethyl disilazane, N,O-(bistrimethylsilyl)acetamide, N,N-(trimethylsilyl)urea, tert-butyldimethyl chlorosilane, vinyl trichlorosilane, vinyl trimethoxysilane, vinyl triethoxysilane, γ-methacryloxy propyl trimethoxysilane, β-(3,4-epoxycyclohexyl)ethyltrimethoxysilane, γ-glycidoxy propyl trimethoxysilane, γ-glycidoxy propyl methyldiethoxysilane, γ-mercaptopropyl trimethoxysilane, γ-chloropropyl trimethoxysilane, and the like. The amount of the hydrophobizing agent varies depending on the kind and the like of the inorganic oxide particles, and may not be uniformly specified, but is preferably from 1 part by weight to 50 parts by weight with respect to 100 parts by weight of the inorganic oxide particles.

The aspect of the invention preferably includes exterior additive (external additive) particles having a volume average particle diameter of from 50 nm to 300 nm, and more preferably from 100 nm to 200 nm. When an external additive-added toner to which the external additive particles are added is applied to the developer, the coating resin on the surface of the carrier is preferably scraped, and the toner may be made to contain a hindered amine additive. When the volume average particle diameter of the external additive particles is 50 nm or more, there is an effect of grinding the coating resin, and, when the volume average particle diameter of the external additive particles is 300 nm or less, the effect may be exhibited without the external additive particles separating from the toner. The external additive particles may be inorganic fine particles or organic particles, but particles having a large particle hardness are preferable. The inorganic particles are preferably particles of $SiO_2$, $TiO_2$, $Al_2O_3$, and the like, and may be particles that have been subjected to a hydrophobization surface treatment. The organic particles are preferably thermosetting particles, crosslinking particles, and the like.

The mixing ratio (weight ratio) of the toner of the exemplary embodiment and the carrier of the exemplary embodiment in a two-component developer is in a range of approximately 1:100 to 30:100 in terms of toner to carrier, and more preferably in a range of approximately 3:100 to 20:100.

Developer cartridge for developing electrostatic charge images, process cartridge, image forming apparatus, and image forming method The developer cartridge for developing electrostatic charge images of the exemplary embodiment (hereinafter sometimes abbreviated to the cartridge) will be described. The cartridge of the exemplary embodiment accommodates at least a developer to be supplied to a toner image forming unit that develops an electrostatic latent image formed on the surface of an electrostatic latent image holding member and forms a toner image, and the developer is the above-described developer of the exemplary embodiment.

Therefore, in an image forming apparatus having a configuration in which the cartridge is attachable and detachable, a toner image for which discoloration is suppressed may be obtained by using the cartridge of the exemplary embodiment in which the developer of the exemplary embodiment is accommodated.

The image forming apparatus of the exemplary embodiment has an image holding member, a charging unit that charges a surface of the image holding member, a latent image forming unit that forms an electrostatic latent image on the surface of the image holding member, a developing unit that develops the electrostatic latent image using a developer so as to form a carrier image (toner image), and a transfer unit that transfers the carrier image to a transfer medium (recording medium), and optionally a fixing unit that fixes the carrier image to the transfer medium, in which the developer is the electrostatic charge image developer according to the exemplary embodiment. The toner containing the electrostatic charge image developer may be a colored toner or a transparent toner as described above.

The image forming method of the exemplary embodiment includes charging a surface of an image holding member; forming an electrostatic latent image on the surface of the image holding member; forming a carrier image by developing the electrostatic latent image formed on the surface of the image holding member using a developer; and transferring the developed carrier image to a transfer medium, in which the developer is the electrostatic charge image developer according to the exemplary embodiment.

In a case in which a developer in which the toner is composed of a colored toner is used, the image forming apparatus of the exemplary embodiment has an electrostatic latent image holding member, a charging unit that charges the surface of the electrostatic latent image holding member, an electrostatic latent image forming unit that forms an electrostatic latent image on the surface of the electrostatic latent image holding member, a developing unit that develops the electrostatic latent image using the developer including the colored toner so as to form a colored toner image, a transfer unit that transfers the colored toner image to a recording medium, and a fixing unit that fixes the colored toner image to the recording medium, and the electrostatic charge image developer (containing the colored toner) of the exemplary embodiment is used as the developer including the colored toner.

In a case in which a colored toner and a transparent toner are used, the image forming apparatus of the exemplary embodiment has a first electrostatic latent image holding member, a charging unit that charges the surface of the electrostatic latent image holding member, an electrostatic latent image forming unit that forms an electrostatic latent image on the surface of the electrostatic latent image holding member, a developing unit that develops the electrostatic latent image using the developer including the colored toner so as to form a colored toner image, and a transfer unit that transfers the colored toner image to a transfer medium, a second electrostatic latent image holding member, a charging unit that charges the surface of the electrostatic latent image holding member, an electrostatic latent image forming unit that forms an electrostatic latent image on the surface of the electrostatic latent image holding member, a developing unit that develops the electrostatic latent image using a developer including a transparent toner so as to form a transparent toner image, a transparent toner image forming unit having a transfer unit that transfers the transparent toner image to a recording medium, and a fixing unit that fixes the colored toner image and the transparent toner image, and the electrostatic charge image developer (containing the transparent toner) of the exemplary embodiment is used as the developer including the transparent toner. The respective units that the colored toner image forming unit and the transparent toner image forming unit have may be shared. For example, the electrostatic latent image forming unit may be shared.

Hereinafter the image forming apparatus of the exemplary embodiment will be described, but the exemplary embodiment is not limited to the following configuration. In addition, the process cartridge of the exemplary embodiment accommodates the electrostatic charge image developer of the exemplary embodiment and has at least one kind from a group consisting of a developing unit that develops the electrostatic latent image formed on the surface of the electrostatic latent image holding member using the electrostatic charge image developer so as to form a toner image, an electrostatic latent image holding member, a charging unit that charges the surface of the electrostatic latent image holding member, and a cleaning unit for removing the toner remaining the surface of the electrostatic latent image holding member.

With regard to an intermediate transfer member, among the image forming apparatuses having a primary transfer unit that transfers the toner image formed on the electrostatic latent image holding member to an intermediate transfer member and a secondary transfer unit that transfers the toner image on the intermediate transfer member to the recording medium, an image forming apparatus having the intermediate transfer belt as the secondary transfer unit is preferable since a high-quality transferred image may be obtained. In addition, the image forming apparatus having the above configuration may be, for example, an ordinary mono-color image forming apparatus accommodating a monochromic toner in a developing apparatus, a color image forming apparatus in which a toner image held on the electrostatic latent image holding member, such as a photoreceptor drum, is primarily transferred to the intermediate transfer member sequentially and repeatedly, a tandem-type color image forming apparatus in which plural electrostatic latent image holding members having developing machines for the respective colors are disposed in series on the intermediate transfer member, or the like.

Meanwhile, in the image forming apparatus, for example, the portion including the developing unit may have a cartridge structure that is attachable to and detachable from the main body of the image forming apparatus (process cartridge). As the process cartridge, the process cartridge according to the exemplary embodiment which has at least a developer holding member and accommodates the electrostatic latent image developer according to the exemplary embodiment is preferably used.

Hereinafter, the image forming apparatus according to the exemplary embodiment will be described with reference to the accompanying drawing. FIG. 1 is a schematic configuration view of an example of the image forming apparatus according to the exemplary embodiment. The image forming apparatus according to the exemplary embodiment has a tandem-type configuration in which plural photoreceptors, that is, plural image forming units are provided as the latent image holding member.

In the image forming apparatus according to the exemplary embodiment, four image forming units 50Y, 50M, 50C, and 50K which form images of the respective colors of yellow, magenta, cyan, and black, and an image forming unit 50T which forms a transparent image are disposed in parallel (in a tandem shape) at intervals as shown in FIG. 1. Here, since the respective image forming units 50Y, 50M, 50C, 50K, and 50T have the same configuration except the colors of the toners in the accommodated developers, hereinafter, the image forming unit 50Y that forms a yellow image will be described as a representative. Furthermore, instead of yellow (Y), magenta (M), cyan (C), black (K), and transparent (T)-attached reference signs will be attached to the same portion as in the image forming unit 50Y so that the respective image forming units 50M, 50C, 50K, and 50T will not described repeatedly. In the exemplary embodiment, the toner according to the exemplary embodiment is used as the toner (transparent toner) in the developer accommodated in the image forming unit 50T.

The yellow image forming unit 50Y has a photoreceptor 11Y as a latent image holding member, and the photoreceptor 11Y is rotary-driven at a predetermined process rate by a driving unit, not shown, in the direction of the arrow A in the drawing. As the photoreceptor 11Y, for example, an organic photoreceptor having sensitivity with respect to the infrared range is used.

A charging roll (charging unit) 18Y is provided at the top portion of the photoreceptor 11Y, a predetermined voltage is applied to the charging roll 18Y through a power supply, not shown, and the surface of the photoreceptor 11Y is charged to a predetermined potential (which also applies to charging rolls 18M, 18C, 18K, and photoreceptors 11M, 11C, 11K).

An exposure apparatus (electrostatic latent image forming unit) 19Y that exposes the surface of the photoreceptor 11Y so as to form an electrostatic latent image is disposed around the photoreceptor 11Y on the downstream side of the charging roll 18Y in the rotation direction of the photoreceptor 11Y. Meanwhile, herein, a miniaturized LED array is used as the exposure apparatus 19Y due to space limitations, the exposure apparatus is not limited thereto, and other electrostatic latent image forming units, such as a laser beam, may also be used.

In addition, a developing apparatus (developing unit) 20Y having a developer holding member that holds a yellow developer is disposed around the photoreceptor 11Y on the downstream side of the exposure apparatus 19Y in the rotation direction of the photoreceptor 11Y, and is configured to visualize an electrostatic latent image formed on the surface of the photoreceptor 11Y using a yellow toner so as to form a toner image on the surface of the photoreceptor 11Y.

An intermediate transfer belt (primary transfer unit) 33 that primarily transfers the toner image formed on the surface of the photoreceptor 11Y is disposed below the photoreceptor 11Y so as to cross below five photoreceptors 11T, 11Y, 11M, 11C, and 11K. The intermediate transfer belt 33 is pressed to the surface of the photoreceptor 11Y using a primary transfer roll 17Y. In addition, the intermediate transfer belt 33 is configured to be tensioned by three rolls, a driving roll 12, a supporting roll 13, and a bias roll 14, and rotates in the direction of the arrow B at the same moving rate as the processing speed of the photoreceptor 11Y. Prior to the yellow toner image primarily transferred in the above manner, a transparent toner image is primarily transferred to the surface of the intermediate transfer belt 33, then, the yellow toner image is primarily transferred, furthermore, toner images of the respective colors, magenta, cyan, and black, are primarily transferred sequentially, and laminated.

In addition, a cleaning apparatus 15Y is disposed around the photoreceptor 11Y on the downstream side of the primary transfer roll 17Y in the rotation direction (the direction of the arrow A) of the photoreceptor 11Y in order to clean the toner remaining on the surface of the photoreceptor 11Y or retransferred toner. A cleaning blade in the cleaning apparatus 15Y is attached so as to be pressed to the surface of the photoreceptor 11Y in the counter direction.

A secondary transfer roll (secondary transfer unit) 34 is pressed to the bias roll 14 that stretches the intermediate transfer belt 33 through an intermediate transfer belt 33. The toner images transferred to and laminated on the surface of the intermediate transfer belt 33 are electrostatically transferred to the surface of a recording medium (transfer medium) P supplied from a paper cassette, not shown, in the pressing portion between the bias roll 14 and the secondary transfer roll 34. At this time, since the toner images transferred and laminated on the intermediate transfer belt 33 has the transparent toner image at the bottom (a location that is in contact with the intermediate transfer belt 33), the transparent toner image is located at the top of the toner image transferred to the surface of the recording paper P.

In addition, a fixing machine (fixing unit) 35 is disposed downstream of the secondary transfer roll 34 in order to fix the toner images transferred multiply on the surface of the recording paper P using heat and pressure so as to form a permanent image.

Further, examples of the fixing machine used in the exemplary embodiment include a belt-shaped fixing belt for which a fluororesin component or a low surface energy material represented by a silicone resin is used at the surface and a fixing roll for which a fluororesin component or a low surface energy material represented by a silicone resin is used at the surface. The fixing belt is a flexible endless belt having a predetermined width and a predetermined circumferential length, and material, thickness, hardness, and the like are selected depending on the apparatus design conditions, such as operation purpose and operation conditions, for the configuration.

When the fixing roll in the fixing unit has a diameter (external diameter) of 100 mm to 500 mm, the thermal history is liable to remain, and melting variation is liable to occur. That is, in a case in which several sheets of thick paper, such as coated paper, (for example, 0.1 mm to 0.7 mm) are continuously fixed, and then thin paper (for example, 60 μm to 500 μm) is fixed, the thermal history of the fixing roll immediately after fixing of thick paper is liable to remain, and, when thin paper is fixed at a low temperature (120° C. or lower), melting variation is liable to occur due to the thermal history. When the toner of the exemplary embodiment is used, melting variation due to the thermal history in a case in which the thin paper is fixed immediately after fixing of thick paper is suppressed even when the diameter of the width of the fixing roll is 100 mm to 500 mm. When melting variation is suppressed, the low temperature fixing properties (for example, fixing properties at 120° C. or lower) are excellent, and the image forming apparatus has no dependency on the thickness of paper, and becomes excellent in terms of paper versatility.

It is assumed that the effects of the low-temperature fixing properties and the paper versatility are both satisfied by including a release agent having a melting temperature Tm of 50° C. to 65° C. and a difference between Tm and Tc of 10° C. to less than 30° C. in the toner and suppressing the crystal growth of the release agent.

When the diameter (external diameter mm) of the fixing roll is from 100 mm to 500 mm, the effects of the low-temperature fixing properties and the paper versatility are exhibited; however, even in the above range, the diameter is preferably from 200 mm to 400 mm, more preferably from 250 mm to 350 mm, and still more preferably from 275 mm to 325 mm. The diameter of the fixing roll in a range of 275 mm to 325 mm is preferable since the effects of the low-temperature fixing properties and the paper versatility become more significant.

Examples of the fixing roll include a cylindrical hard roll made of aluminum or the like and having an external diameter of from 100 mm to 500 mm, a thickness of 10 mm, and a predetermined length. However, the fixing roll is not limited to the above configuration, but the fixing roll requires a configuration that functions as a sufficiently hard roll in order to prevent deformation with respect to a pressing force from a pressurization roll when a nipping portion is formed between the pressurization roll and the fixing roll. In addition, the surface of the fixing roll may be coated with 200 μm-thick fluororesin or the like as a protective layer that prevents metal abrasion.

A halogen heater is disposed in the fixing roll as a heating unit. Examples thereof include a belt-shaped fixing belt for which a fluororesin component or a low surface energy material represented by a silicone resin is used at the surface and a cylindrical fixing roll for which a fluororesin component or a low surface energy material represented by a silicone resin is used at the surface.

Next, the operations of the respective image forming units 50T, 50Y, 50M, 50C, and 50K which form images of the respective colors, transparent, yellow, magenta, cyan, and black, will be described. Since the operations of the respective image forming units 50T, 50Y, 50M, 50C, and 50K are the same respectively, the operation of the yellow image forming unit 50Y will be described as a representative.

In the yellow developing unit 50Y, the photoreceptor 11Y rotates in the direction of the arrow A at a predetermined process speed. The surface of the photoreceptor 11Y is negatively charged to a predetermined potential using the charging roll 18Y. After that, the surface of the photoreceptor 11Y is exposed using the exposure apparatus 19Y, and an electrostatic latent image is formed according to image information. Subsequently, the toner negatively charged by the developing apparatus 20Y is reversely developed, and the electrostatic latent image formed on the surface of the photoreceptor 11Y is visualized on the surface of the photoreceptor 11Y, thereby forming a toner image. After that, the toner image on the surface of the photoreceptor 11Y is primarily transferred to the surface of the intermediate transfer belt 33 using the primary transfer roll 17Y. After the primary transfer, transfer residual components, such as the toner remaining on the surface of the photoreceptor 11Y, are scraped and cleaned using the cleaning blade in the cleaning apparatus 15Y so as to prepare the following image forming process.

The above operation is carried out in the respective image forming units, 50T, 50Y, 50M, 50C, and 50K, and toner images visualized on the surfaces of the respective photoreceptors, 11T, 11Y, 11M, 11C, and 11K, are sequentially transferred multiply to the surface of the intermediate transfer belt 33. In a color mode, toner images of the respective colors are transferred multiply in an order of transparent, yellow, magenta, cyan, and black, and, even in a dichromatic or trichromatic mode, toner images of the necessary colors are singly or multiply transferred in the same order. After that, the toner image singly or multiply transferred to the surface of the intermediate belt 33 is secondarily transferred to the surface of the recording paper P transported from the paper cassette, not shown, through the secondary roll 34, subsequently, heated and pressurized using the fixing machine 35 so as to be fixed. The toner remaining on the surface of the intermediate transfer belt 33 after the secondary transfer is cleaned using a belt cleaner 16 constituted by a cleaning blade for the intermediate transfer belt 33.

In FIG. 1, the yellow image forming unit 50Y is configured as a process cartridge that is detachable from the main body of the image forming apparatus by integrating the developing apparatus 20Y including the developer holding member that holds the yellow color electrostatic latent image developer, the photoreceptor 11Y, the charging roll 18Y, and the cleaning apparatus 15Y. In addition, the image forming units 50T, 50K, 50C, and 50M are also configured as process cartridges in the same manner as the image forming unit 50Y.

Next, the toner cartridge according to the exemplary embodiment will be described. The toner cartridge according to the exemplary embodiment is mounted so as to be detachable from the image forming apparatus, and accommodates a toner to be supplied to the developing unit provided in the image forming apparatus. Meanwhile, the toner cartridge according to the exemplary embodiment may accommodate at least a toner, and may accommodate, for example, a developer depending on the mechanism of the image forming apparatus.

Therefore, in the image forming apparatus having a configuration in which the toner cartridge is detachable, the toner according to the exemplary embodiment is easily supplied to the developing apparatus by using the toner cartridge that accommodates the toner according to the exemplary embodiment.

Meanwhile, the image forming apparatus shown in FIG. 1 is an image forming apparatus having a configuration in which the toner cartridges 40Y, 40M, 40C, 40K, and 40T are attachable and detachable, and the developing apparatuses 20Y, 20M, 20C, 20K, and 20T are connected to the toner cartridges corresponding to the respective developing apparatuses (colors) through toner supply pipes, not shown. In addition, in a case in which the amount of toner accommodated in the toner cartridge runs low, the toner cartridge may be exchanged.

Meanwhile, in the above, units that laminate the respective colored toner images, yellow, magenta, cyan, and black, which are generally formed through color decomposition, and a transparent toner image so as to form a color image have been described; however, in a case in which only a colored toner image is formed, an image forming apparatus which does not have a portion that forms a transparent toner image, among the image forming units in the image forming apparatus, may be used. In addition, the exemplary embodiment includes not only a case in which a four-color colored toner image is transferred to a recording medium, but also a case in which mono-, di- and trichromatic colored toner images or mono-, di- and trichromatic colored toner images and a transparent toner image are laminated and transferred to a recording medium.

EXAMPLES

Hereinafter, an aspect of the invention will be described specifically using examples and comparative examples, but the invention is not limited to the following examples. Meanwhile, in the following description, "parts" refer to "parts by weight" unless otherwise described.

Example 1

Preparation of Resin Particle Dispersion Liquid 1

A dissolved mixture of 300 parts of styrene, 140 parts of n-butylacrylate, 8 parts of acrylic acid, and 6 parts of dodecanethiol is emulsification-polymerized in a flask containing 4 parts of a nonionic surfactant (NONIPOL 400, manufactured by Sanyo Chemical Industries, Ltd.) and 8 parts of an anionic surfactant (NEOGEN SC, manufactured by Dai-ichi Kogyo Seiyaku Co., Ltd.) dissolved in 550 parts of deionized water, and 50 parts of deionized water in which 5 parts of ammonium persulfate is dissolved is added into the mixture while slowly mixing the mixture for 10 minutes. After nitrogen substitution is carried out, the mixture is heated in an oil bath until the content reaches 70° C. while stirring the mixture in the flask, and the emulsification polymerization is continued for 5 hours. As a result, a resin particle dispersion liquid 1 in which resin particles having an average particle diameter of 200 nm, Tg of 54° C., and a weight average molecular weight Mw of 30000 are dispersed is obtained. Water is added to the resin particle dispersion liquid 1 so as to adjust the solid content concentration to 40% by weight.

Preparation of Release Agent Dispersion Liquid 1

Composition of Release Agent Dispersion Liquid 1

Paraffin wax (HNP0190, manufactured by Nippon Seiro Co., Ltd., melting point of 85° C.) 100 parts Cationic surfactant (SANISOL B50, manufactured by Kao Corporation) 5 parts Deionized water 240 parts After the components shown in the composition of the release agent dispersion liquid 1 are dispersed in a round stainless steel flask for 10 minutes using a homogenizer (ULTRA-TURRAX T50, manufactured by IKA), and a dispersion treatment is carried out using a pressure ejection-type homogenizer, thereby preparing a release agent dispersion liquid 1 in which release agent particles having an average particle diameter of 350 nm are dispersed.

Preparation of Transparent Toner (1)

Composition of Transparent Toner (1)

Resin particle dispersion liquid 264 parts

Release agent dispersion liquid 40 parts

Polyaluminum chloride (manufactured by Asada Chemical Industry Co., Ltd., PAC100W) 1.8 parts Deionized water 600 parts The components shown in the composition of the transparent toner (1) are mixed and dispersed in a round stainless steel flask using a homogenizer (ULTRA-TURRAX T50, manufactured by IKA), and heated to 50° C. while stirring the mixture in the flask in an oil bath for heating. After the mixture is held at 50° C. for 100 minutes, aggregated particles 1 having a volume average particle diameter D50 of 4.8 μm are generated is confirmed. After 32 parts by weight of the resin particle dispersion liquid is added to the dispersion liquid including the aggregated particles 1, the temperature of the oil bath for heating is increased to 50° C. and held for 30 minutes. After the pH of the system is adjusted to 5.0 by adding 1N sodium hydroxide, the stainless steel flask is sealed, heated to 98° C. while continuously stirring the mixture using a magnetic seal, and the pH is held at 5.5 for 2 hours. After cooling, the toner parent particles are filtered, washed 4 times using ion exchange water, and then freeze-dried, thereby obtaining a transparent toner (1). The volume average particle diameter D50v of the toner is 5.5 μm.

Manufacturing of External Additive-Added Toner A

Next, 1.2 parts by weight of silicone oil-treated silica particles (RY50, manufactured by Nippon Aerosil Co., Ltd.) having an average particle diameter of 40 nm and 1.5 parts by weight of HMDS-treated silica particles having an average particle diameter of 150 nm are mixed with 100 parts by weight of the obtained transparent toner (1) using a sample mill, thereby manufacturing an external additive-added toner A.

Manufacturing of Carrier 1

Composition of Carrier 1

Mn—Mg ferrite particles (volume average particle diameter: 35 μm) 100 parts

Cyclohexyl methacrylate/methylmethacrylate copolymer (copolymerization ratio 90:10 [mol], weight average molecular weight: 70000) 2.5 parts Hindered amine additive (LA-77Y: bis(2,2,6,6-tetramethyl-4-piperidyl)sebacate, manufactured by ADEKA Corporation, molecular weight: 481) 0.5 part Toluene 14 parts The respective components shown in the composition of the carrier except Mn—Mg ferrite particles and glass beads (ϕ1 mm, the same amount as toluene) are stirred using a sand mill manufactured by Kansai Paint Co., Ltd. at 1200 rpm/30 min so as to prepare a resin coated layer forming solution 1. Furthermore, the resin coated layer forming solution 1 and the Mn—Mg ferrite particles are put into a vacuum deairing kneader, and the toluene is distilled away, thereby forming a carrier coated with the resin. Subsequently, fine powder and coarse powder are removed using an elbow jet, thereby obtaining a carrier 1.

Preparation of Developer 1

External additive-added toner A (8 parts) and the carrier 1 (100 parts) are stirred using a. V blender at 40 rpm×20 minutes, and sieved using a sieve having an aperture size of 212 μm, thereby obtaining a developer 1.

Example 2

Preparation of Yellow Colorant Dispersion Liquid 1

Composition of Yellow Colorant Dispersion Liquid 1

C.I. Pigment Yellow 180 60 parts

Nonionic surfactant (NONIPOL 400, manufactured by Sanyo Chemical Industries, Ltd.) 5 parts Ion exchange water 240 parts The components shown in the composition of the yellow colorant dispersion liquid 1 are mixed, dissolved, stirred for 10 minutes using a homogenizer (ULTRA-TURRAX T50, manufactured by IKA), and then subjected to a dispersion treatment for 10 minutes using an ALTIMIZER, thereby preparing a colorant dispersion liquid 1 in which colorant (yellow pigment) particles having an average particle diameter of 300 nm are dispersed.

Preparation of Yellow Toner (1)

A yellow toner (1) having a volume average particle diameter D50v of 5.5 μm and a shape coefficient of 133 is obtained in the same manner as in Example 1 except that 35 parts of the colorant dispersion liquid is added in addition to the components shown in the composition of the transparent toner (1) in the preparation of the transparent toner (1).

Manufacturing of External Additive-Added Toner B

Next, 1.2 parts by weight of silicone oil-treated silicon oxide particles (RY50, manufactured by Nippon Aerosil Co., Ltd.) having an average particle diameter of 40 nm and 1.5 parts by weight of crosslinked styrene/methyl methacrylate particles having an average particle diameter of 200 nm are mixed with 100 parts by weight of the obtained yellow toner (1) using a sample mill, thereby manufacturing an external additive-added toner B.

Preparation of Developer 3

A developer 3 is obtained in the same manner except that the carrier 1 in the preparation of the developer 2 is changed to the carrier 2.

Example 4

Manufacturing of Carrier 3

Composition of Carrier 3

A carrier 3 is obtained using the same method as the method of manufacturing the carrier 2 except that the hindered amine additive is changed to CHIMASSORB 2020FDL having the following structure (manufactured by BASF Corporation, molecular weight: 3800).

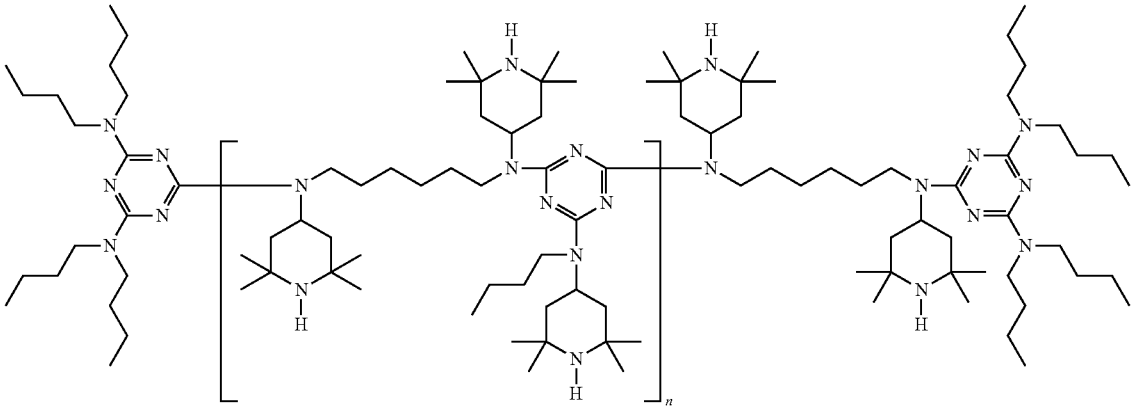

Preparation of Developer 2

A developer 2 is obtained in the same manner except that the external additive-added toner A in the preparation of the developer 1 is changed to the external additive-added toner B.

Example 3

Manufacturing of Carrier 2

Composition of Carrier 2

Mn—Mg ferrite particles (volume average particle diameter: 35 μm) 100 parts

Cyclohexyl methacrylate/methyl methacrylate copolymer (copolymerization ratio 80:20 [mol], weight average molecular weight: 70000) 2.5 parts Hindered amine additive (LA-57: 1,2,3,4-butanetetracarboxylic acid tetrakis(2,2,6,6-tetramethyl-4-piperidyl) ester, manufactured by ADEKA Corporation, molecular weight: 791) 0.5 part Toluene 14 parts The respective components shown in the composition of the carrier except Mn—Mg ferrite particles and glass beads (ϕ1 mm, the same amount as toluene) are stirred using a sand mill manufactured by Kansai Paint Co., Ltd. at 1200 rpm/30 min so as to prepare a resin coated layer forming solution 2.

Furthermore, the resin coated layer forming solution 1 and the Mn—Mg ferrite particles are put into a vacuum deairing kneader, and the toluene is distilled away, thereby forming a carrier coated with the resin. Subsequently, fine powder and coarse powder are removed using an elbow jet, thereby obtaining a carrier 2.

Preparation of Developer 4

A developer 4 is obtained in the same manner except that the carrier 1 in the preparation of the developer 2 is changed to the carrier 3.

Comparative Example 1

Manufacturing of Carrier 4

A carrier 4 coated with a resin is obtained in the same manner except that the hindered amine additive in the manufacturing of the carrier 1 is not used.

Preparation of Developer 5

A developer 5 is obtained in the same manner except that the carrier 1 in the preparation of the developer 1 is changed to the carrier 4.

Comparative Example 2

Preparation of Developer 6

A developer 6 is obtained in the same manner except that the carrier 2 in the preparation of the developer 2 is changed to the carrier 4.

Example 5

Manufacturing of Carrier 5

A carrier 5 coated with a resin is obtained in the same manner except that the hindered amine additive in the manufacturing of the carrier 1 is changed to LA-87: 3-(2,2,6,6-tetramethyl-4-piperidinyl)-2-methyl-1-propen-3-one (manufactured by ADEKA Corporation, molecular weight: 209).

Preparation of Developer 7

A developer 7 is obtained in the same manner except that the carrier 1 in the preparation of the developer 1 is changed to the carrier 5.

Example 6

Manufacturing of Carrier 6

A carrier 6 coated with a resin is obtained in the same manner except that the hindered amine additive in the manufacturing of the carrier 1 is changed to cyclohexyl acrylate/LA-87[3-(2,2,6,6-tetramethyl-4-piperidinyl)-2-methyl-1-propen-3-one, manufactured by ADEKA Corporation, molecular weight: 209] copolymerized resin (molecular weight: 5000).

Preparation of Developer 8

A developer 8 is obtained in the same manner except that the carrier 1 in the preparation of the developer 1 is changed to the carrier 6.

Example 7

Manufacturing of Carrier 7

Composition of Carrier 7

Mn—Mg ferrite particles (volume average particle diameter: 35 μm) 100 parts

Cyclohexyl methacrylate/methyl methacrylate copolymer (copolymerization ratio 90:10 [mol], weight average molecular weight: 70000) 2.9 parts Hindered amine additive (LA-77Y: bis(2,2,6,6-tetramethyl-4-piperidyl)sebacate, manufactured by ADEKA Corporation, molecular weight: 481) 0.1 part Toluene 14 parts A carrier 7 is obtained using the same manufacturing method as for the carrier 1 except that the composition of the carrier is changed as described above.

Preparation of Developer 9

A developer 9 is obtained in the same manner except that the carrier 1 in the preparation of the developer 1 is changed to the carrier 7.

Example 8

Manufacturing of Carrier 8

Composition of Carrier 8

Mn—Mg ferrite particles (volume average particle diameter: 35 μm) 100 parts

Cyclohexyl methacrylate/methyl methacrylate copolymer (copolymerization ratio 90:10 [mol], weight average molecular weight: 70000) 2.7 parts Hindered amine additive (LA-77Y: bis(2,2,6,6-tetramethyl-4-piperidyl) sebacate, manufactured by ADEKA Corporation, molecular weight: 481) 0.4 part Toluene 14 parts A carrier 8 is obtained using the same manufacturing method as for the carrier 1 except that the composition of the carrier is changed as described above.

Preparation of Developer 10

A developer 10 is obtained in the same manner except that the carrier 1 in the preparation of the developer 1 is changed to the carrier 8.

Example 9

Manufacturing of Carrier 9

Composition of Carrier 9

Mn—Mg ferrite particles (volume average particle diameter: 35 μm) 100 parts

Cyclohexyl methacrylate/methylmethacrylate copolymer (copolymerization ratio 90:10 [mol], weight average molecular weight: 70000) 2.0 parts CHIMASSORB 2020FDL (manufactured by BASF Corporation, molecular weight: 3800) 1.0 part Toluene 14 parts A carrier 9 is obtained using the same manufacturing method as for the carrier 1 except that the composition of the carrier is changed as described above.

Preparation of Developer 11

A developer 11 is obtained in the same manner except that the carrier 1 in the preparation of the developer 1 is changed to the carrier 9.

Image Output Using Evaluating Machine

The developers 1 to 11 are mounted in a reformed copy machine DocuCenterColor f450 manufactured by Fuji Xerox Co., Ltd., the toner weight on the paper is adjusted to be 0.7 mg/cm$^2$ under an environment of 23° C. and 55%, image outputting is carried out respectively on 10000 sheets of J paper manufactured by Fuji Xerox Co., Ltd. in a monochromatic mode so as to form a 5 cm×5 cm solid, and the light resistance and color unevenness of the obtained image samples and the fluidity of the developers are evaluated into 3 to 5 grades based on the following evaluation standards. The results are shown in Table 1. Meanwhile, in the respective evaluations, the grades A and B are determined to cause no problem in actual use.

Evaluation Items

1. Evaluation of Light Resistance

Evaluation of light resistance shown by ΔE and Δgloss in Table 1 is carried out in the following order. Firstly, the densities of the colors of the image samples obtained at 10$^{th}$ sheet output, 10,000$^{th}$ sheet output, and 50,000$^{th}$ sheet output are measured using a density measuring instrument (X-Rite938, manufactured by X-Rite, Incorporated), the surface glossiness of the image samples is measured using a glossiness measuring machine (manufactured by Murakami Color Research Laboratory, 75 degrees), and the densities and the surface glossiness are used as standard color density and standard glossiness.

Subsequently, ultraviolet rays are irradiated on the image samples for 200 hours using a light resistance testing machine (irradiation conditions: xenon arc light, wavelength: 380 nm, irradiation intensity: 100 klux), and the color density and glossiness of the ultraviolet ray-irradiated image sample are measured in the same manner.

From the above measured values, the color difference between color before and after the ultraviolet ray irradiation ΔE=[(L1−L2)2+(a1−a2)2+(b1−b2)2]½ and the difference in glossiness before and after ultraviolet ray irradiation (Δgloss represented by the following formula) are obtained.

$$\Delta gloss = 100 - (\text{standard glossiness} - \text{glossiness after irradiation}/\text{standard glossiness}) \times 100 \quad \text{[Formula 1]}$$

The evaluation standards of ΔE and Δgloss are as follows.

Evaluation standards of ΔE

A: ΔE is less than 5

B: ΔE is 5 to less than 10

C: ΔE is 10 to less than 15

D: ΔE is 15 or more

Evaluation standards of Δgloss

A: Δgloss is 95% or more

B: Δgloss is 90% to less than 95%

C: Δgloss is 85% to less than 90%

D: Δgloss is 80% to less than 85%

E: Δgloss is 80% or more

2. Color Unevenness

The color unevenness of the image sample at $10,000^{th}$ paper output is visually evaluated.

Evaluation Standards

A: Color unevenness is not observed

B: Color unevenness is slightly observed, but remains at a level which is not a problem C: Color unevenness is remarkably observed.

TABLE 1

| | | $10^{th}$ sheet | | $10000^{th}$ sheet | | $50000^{th}$ sheet | | Color |
|---|---|---|---|---|---|---|---|---|
| | Developer | ΔE | Δgloss | ΔE | Δgloss | ΔE | Δgloss | unevenness |
| Examples | Developer 1 | A | A | A | A | A | A | A |
| | Developer 2 | A | A | A | A | A | A | A |
| | Developer 3 | A | A | A | A | A | A | A |
| | Developer 4 | A | A | A | A | A | A | A |
| | Developer 7 | A | A | A | A | B | B | C |
| | Developer 8 | B | B | B | B | A | A | A |
| | Developer 9 | A | A | B | B | B | B | A |
| | Developer 10 | A | A | A | A | A | A | A |
| | Developer 11 | A | A | A | A | A | A | B |
| Comparative examples | Developer 5 | C | C | C | C | C | C | A |
| | Developer 6 | C | C | C | C | C | C | A |

From Table 1, it is evident that discoloration is suppressed in the toner images formed using the developer of the Examples compared to the toner images formed using the developers of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

magnetic particles; and a coating resin layer that coats surfaces of the magnetic particles and contains a hindered amine compound, wherein a content of the hindered amine compound is in a range of 12.9% by weight to 50% by weight with respect to a total weight of the coating resin layer.

2. The electrostatic charge image developing carrier according to claim 1, wherein a molecular weight of the hindered amine compound is in a range of 400 to 4000.

3. The electrostatic charge image developing carrier according to claim 1, wherein the coating resin layer has resin particles.

4. The electrostatic charge image developing carrier according to claim 1, wherein the hindered amine compound has a 2,2,6,6-tetraalkyl piperidine structure and a molecular weight in a range of 400 to 4000.

5. The electrostatic charge image developing carrier according to claim 3, wherein a volume average particle diameter of the resin particles is in a range of 0.1 μm to 2 μm.

6. The electrostatic charge image developing carrier according to claim 1, wherein a volume intrinsic resistance of the carrier is $10^6$ Ωcm to less than $10^{14}$ Ωcm under an electric field of $10^4$ V/cm.

7. The electrostatic charge image developing carrier according to claim 1, wherein an average film thickness of the resin coated layer is in a range of 0.5 μm to 3 μm.

8. An electrostatic charge image developer comprising:

the carrier according to claim 1; and a toner.

9. The electrostatic charge image developer according to claim 8, wherein the hindered amine compound in the carrier has a molecular weight in a range of 400 to 4000.

10. A developer cartridge comprising:

a toner accommodating chamber, wherein the electrostatic charge image developer according to claim 8 is contained in the toner accommodating chamber.

11. A process cartridge for an image forming apparatus comprising:

a developer holding member that holds and carries an electrostatic charge image developer, wherein the developer is the electrostatic charge image developer according to claim 8.

12. The process cartridge for an image forming apparatus according to claim 11, wherein the hindered amine compound in the carrier has a molecular weight in a range of 400 to 4000.

13. An image forming apparatus comprising:

an image holding member;

a charging unit that charges a surface of the image holding member;

a latent image forming unit that forms an electrostatic latent image on the surface of the image holding member;

a developing unit that develops the electrostatic latent image formed on the surface of the image holding member using a developer so as to form a toner image; and a transfer unit that transfers the developed toner image to a transfer medium, wherein the developer is the electrostatic charge image developer according to claim 8.

14. The image forming apparatus according to claim 13, wherein the hindered amine compound in the carrier has a molecular weight in a range of 400 to 4000.

15. An image forming method comprising:

charging a surface of an image holding member;

forming an electrostatic latent image on the surface of the image holding member;

forming a toner image by developing the electrostatic latent image formed on the surface of the image holding member using a developer; and transferring the developed toner image to a transfer medium, wherein the developer is the electrostatic charge image developer according to claim 8.

16. The image forming method according to claim 15, wherein the hindered amine compound in the carrier has a molecular weight in a range of 400 to 4000.

* * * * *